United States Patent [19]

Focke et al.

[11] 4,300,676

[45] Nov. 17, 1981

[54] PACK, MORE PARTICULARLY A CUBOID PACK, FOR CIGARETTES, SMALL CIGARS AND THE LIKE

[75] Inventors: Heinz H. Focke; Kurt Liedtke, both of Verden, Fed. Rep. of Germany

[73] Assignee: Focke & Co., Verden, Fed. Rep. of Germany

[21] Appl. No.: 102,513

[22] Filed: Dec. 11, 1979

[30] Foreign Application Priority Data

Dec. 16, 1978 [DE] Fed. Rep. of Germany ..... 2854443

[51] Int. Cl.[3] ..... B65D 85/10; B65D 85/12

[52] U.S. Cl. ..... 206/264; 206/628; 206/629; 206/632

[58] Field of Search ..... 206/264, 628, 629, 630, 206/631, 632, 633

[56] References Cited

U.S. PATENT DOCUMENTS

| | | | |
|---|---|---|---|
| 2,760,713 | 8/1956 | Andrews | 206/633 |
| 3,093,292 | 6/1963 | Ahlbor | 206/264 |
| 3,245,525 | 4/1966 | Shoemaker | 206/264 |
| 3,270,945 | 9/1966 | Whitaker | 206/264 |
| 3,333,683 | 8/1967 | Scharre | 206/633 |
| 3,680,772 | 8/1972 | Hoover | 206/633 |
| 3,999,655 | 12/1976 | Molins et al. | 206/264 |

*Primary Examiner*—Joseph Man-Fu Moy

*Attorney, Agent, or Firm*—Sughrue, Mion, Zinn, Macpeak and Seas

[57] ABSTRACT

A cuboid pack for cigarettes, small cigars and the like, comprises a wrap consisting of a thin packaging material, and an outer wrap. The outer wrap comprises a hinge lid box including a collar having a cut-out formed therein. A freely projecting tear-open tab is formed by a material overlap which extends transversely across a front wall side of the thin wrap within the region of the cut-out. A free edge portion of said tear-open tab rests upon an external portion of the collar and the tear-open tab adjoining a pull-off strip extending upwardly from the cut-out.

21 Claims, 19 Drawing Figures

Figure 1:
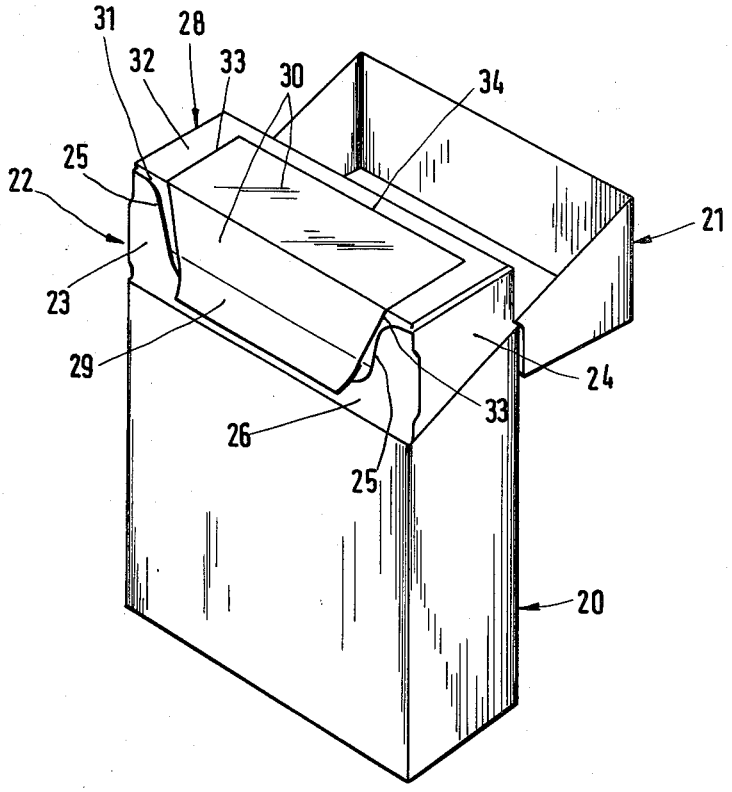

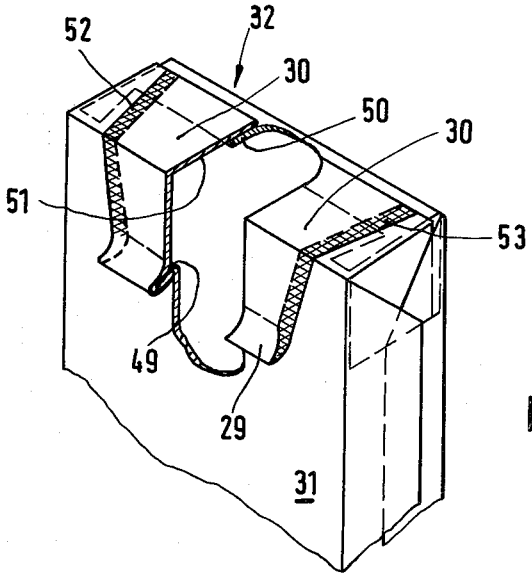
Fig.18
Fig.19
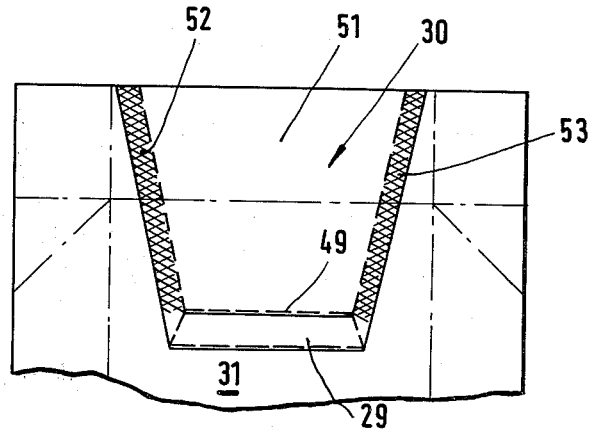

PACK, MORE PARTICULARLY A CUBOID PACK, FOR CIGARETTES, SMALL CIGARS AND THE LIKE

The invention relates to a pack, more particularly a cuboid pack, for cigarettes, small cigars and the like, with a wrap consisting of a thin packaging material (laminated foil, tinfoil and the like) and preferably an outer wrap, in particular a hinge-lid box, a cup or the like.

The invention above all relates to cuboid cigarette packs, but can also be employed for other types of pack.

In designing cigarette packs, the impermeability of the pack is an important subject, because the preservation of the quality of the cigarettes over what can, under certain circumstances, be a lengthy period before the cigarettes are consumed depends thereon.

Currently, it is predominantly two different embodiments of cigarette packs which are encountered on the market, namely hinge-lid boxes or hinge-lid packs, on the one hand, and soft cup packs, on the other hand. Both embodiments have a basic construction in common, inasmuch as the cigarettes are accommodated in an inner wrap of tinfoil. This is placed in the actual (hinge-lid box or soft cup) pack. Finally, a regenerated cellulose film wrap is provided as the outer wrap. In spite of this three-part construction, the preserving effect is unsatisfactory.

The interest of the relevant commercial circles is directed towards developing a cigarette pack which is substantially aroma-tight. In the course of such endeavours, a "one-piece" cigarette pack, made from a laminated foil, has already been introduced on the market. Other endeavours are in the direction of making the inner wrap of an otherwise conventional pack impermeable by appropriately folding and gluing this wrap.

A general problem in designing the packs under discussion here is the formation of an opening device or tear-open device for the sole wrap or inner wrap. In the pack already referred to, made from laminated foil, a tear strip is marked out by partial perforation of the multi-layer foil. The tear strip is present in the area of the upper end face of the pack, with a gripping orifice waiting to be exposed in the region of the adjoining side wall. This tear-open mechanism is complicated and expensive to manufacture, and is furthermore only applicable to certain types of pack and certain packaging materials.

It is the object of the invention to provide a device for opening sealed packs or wraps, which is simple to produce and easy to manipulate, in particular preferably in conjunction with impermeable packs for cigarettes and the like.

To achieve this object, the wrap is, according to the invention, provided on one side, especially in the region of a front wall, with a freely projecting tear-open tab, which is formed by material overlap. The projecting material overlap, according to a further proposal of the invention, is in the form of a fold of the packaging material, the fold being formed in the wrap.

For easy and rapid manipulation of the pack when opening the latter it is desirable to have a free portion of material, namely a portion which can, for example, be gripped between the thumb and index finger. Inherently, the inner wraps of tinfoil or the like, when folded in the conventional way, form tabs in the region of an end face upper wall, and these tabs can serve as the tear-open mechanism. If the constructional design is different, or if the tabs are firmly glued or welded to one another, this possibility is not available. The invention provides a free tear-open tab present in a different face and separately produced.

According to the invention, the tear-open tab is adjoined by a pull-off strip, formed within the wrap, by means of which strip an orifice is exposed. The pull-off strip can be marked out beforehand by appropriate pretreatment of the packaging material, for example by punching, by perforation cuts or possibly by thermal-mechanical embossing, so that an orifice of a certain size and shape is exposed by means of the pull-off strip.

The invention can also be employed advantageously with those wraps which inherently are devoid of tabs and the like in the region which is of interest for creating an orifice. Accordingly, the wrap can be so constructed that the front wall and end face, which are preferred regions for forming an orifice in the pack, are free from closing tabs. In the case of an inner wrap for cigarette packs, this wrap can be folded in a U-shape around the contents of the pack, in such a way that the mutually overlapping closing tabs are—except in the region of the side walls—formed solely in the region of the bottom. In this case, the front wall is provided with a tear-open tab formed by folding. If, on the other hand, a fold is provided in the region of the upper wall, the pull-off strip which adjoins the tear-open tab can, in the region of this upper wall, extend over the full width of the latter, up to the end of the blank from which the wrap is formed.

In the case of packs which are suitable, especially hinge-lid packs with an inserted collar, the tear-open tab is so arranged that at least a part-region thereof rests externally on the collar, in the region of a cut-out portion of the collar. This facilitates access to the tear-open tab.

Further features of the invention relate to the constructional design of the wrap, in particular also with the object of providing a substantially impermeable pack.

Figure 2:
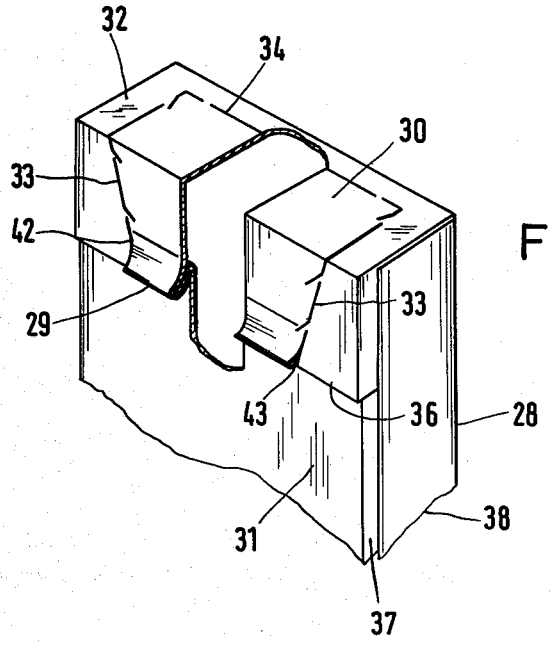
Figure 3:
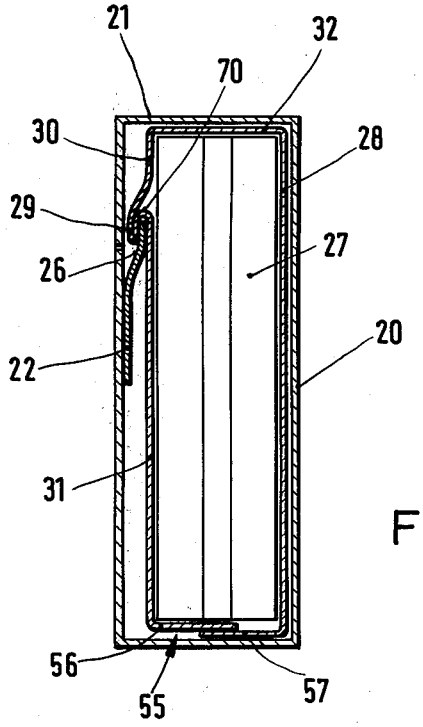
Figure 4:
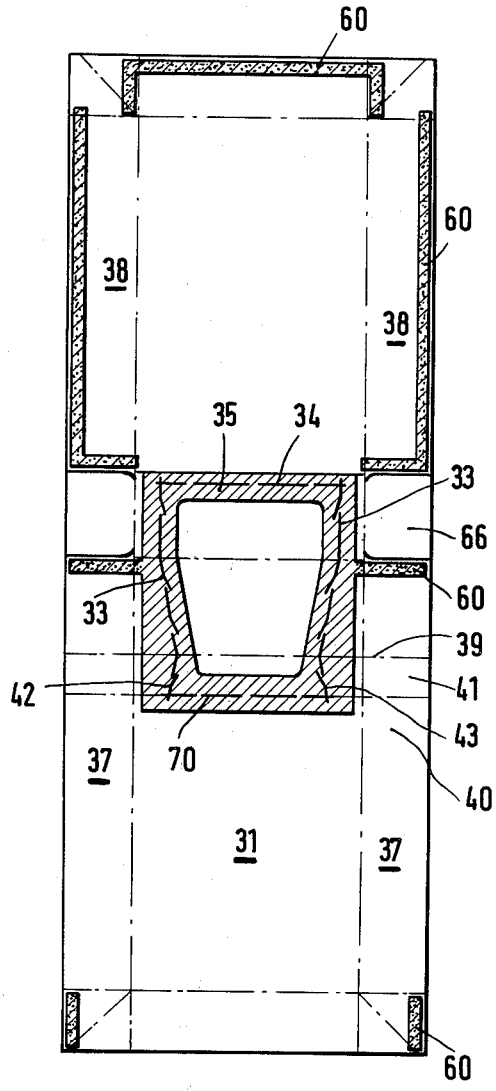
Figure 5:
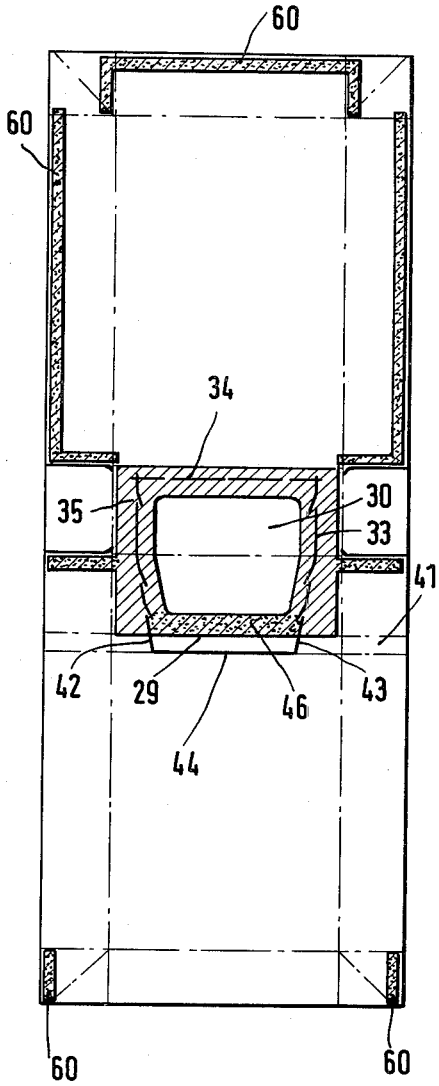
Figure 6:
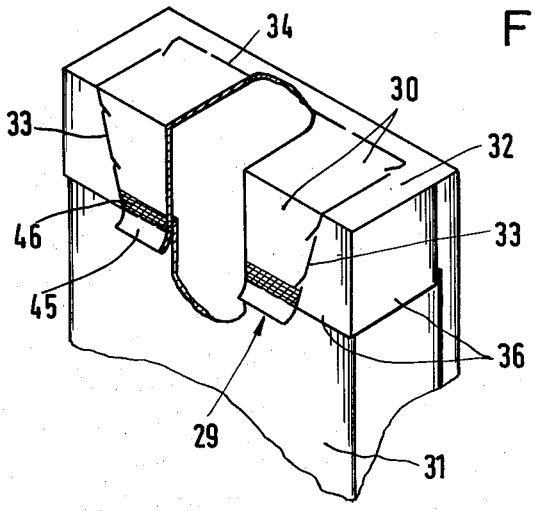
Figure 7:
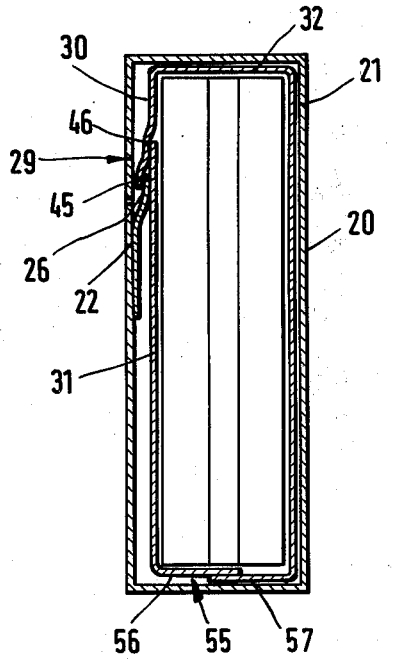
Figure 8:
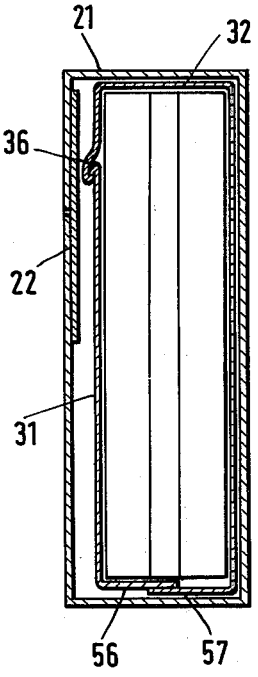
Figure 9:
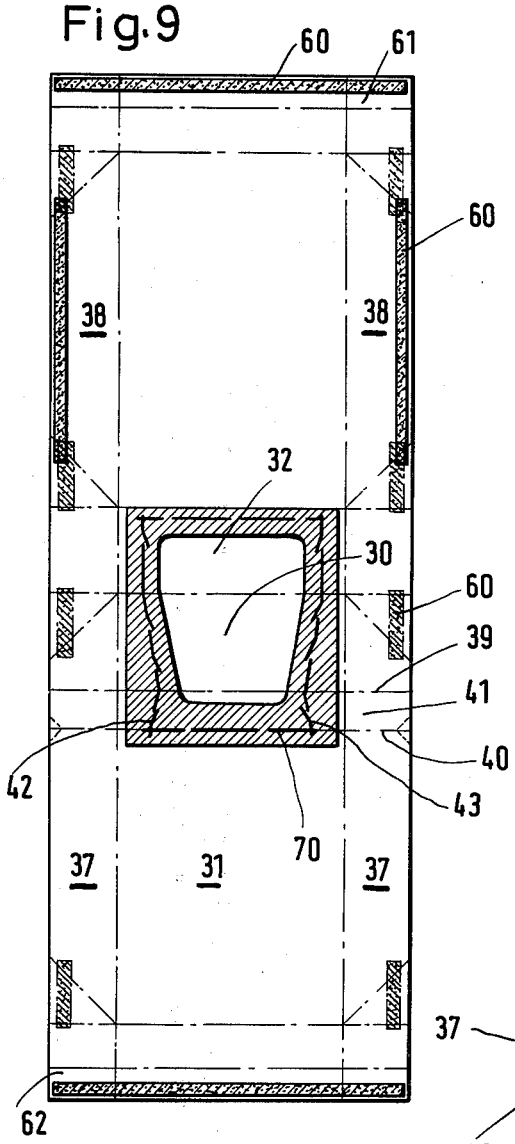
Figure 10:
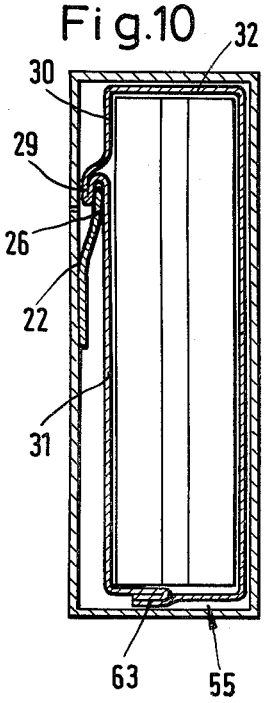
Figure 11:
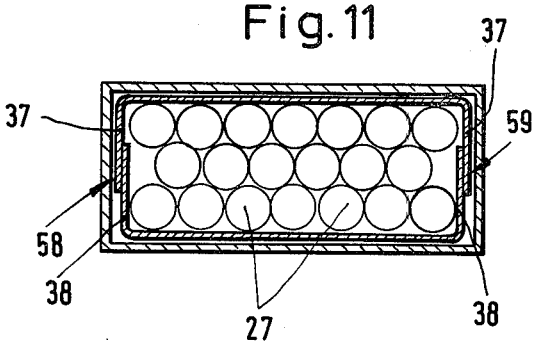
Figure 12:
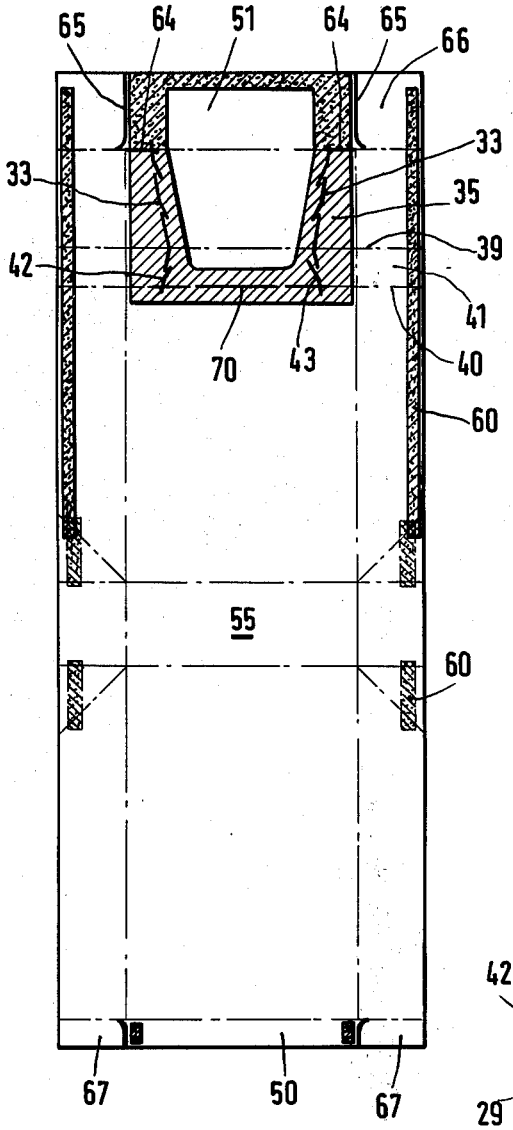
Figure 13:
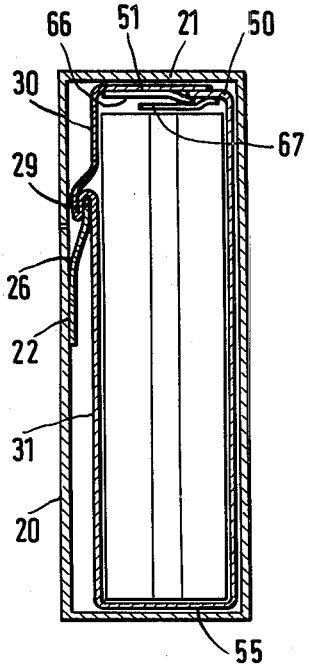
Figure 14:
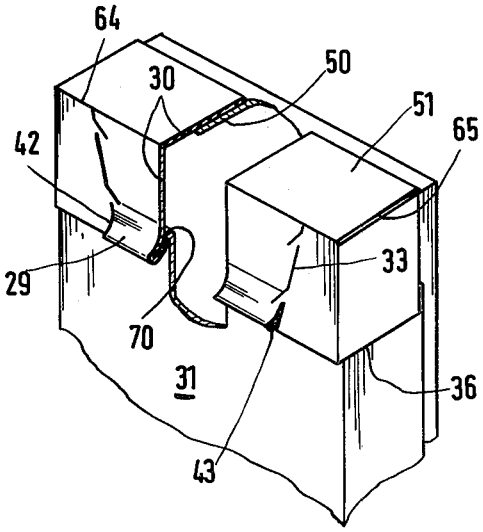
Figure 15:
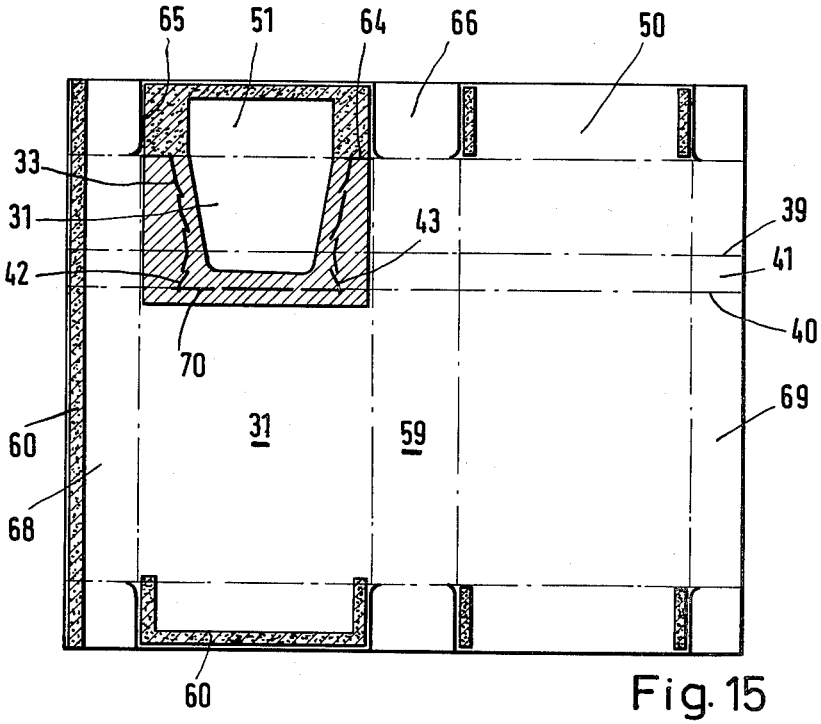
Figure 16:
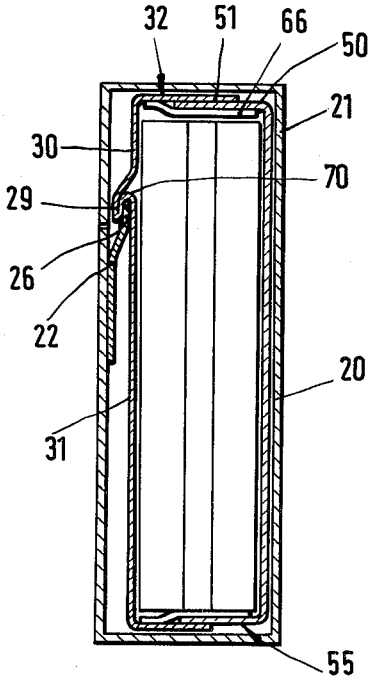
Figure 17:
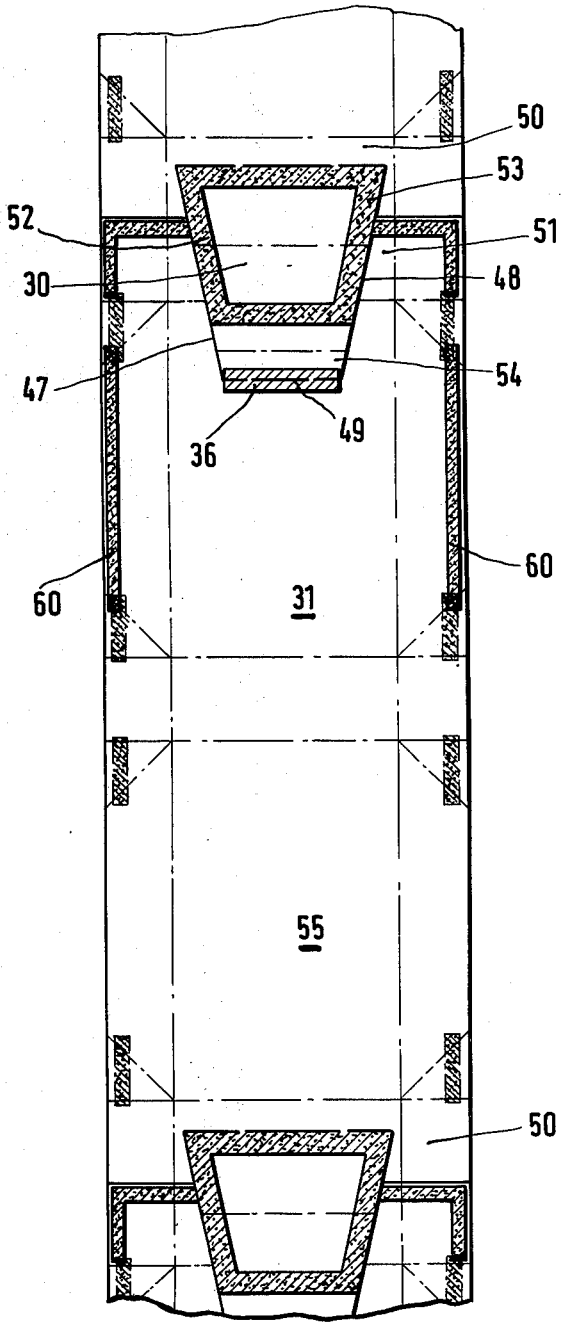

Illustrative embodiments of the invention are explained in more detail below in relation to the drawings. In these:

FIG. 1 shows a cigarette pack of the hinge-lid type in perspective view, with the hinge-lid open, FIG. 2 shows the upper region of a wrap in perspective view, and in particular shows the contents of the pack according to FIG. 1, FIG. 3 shows a vertical section through the pack according to FIG. 1, in the middle region thereof, with the hinge-lid closed, FIG. 4 shows a laid-flat blank for the (inner) wrap of a pack according to FIGS. 1 to 3, FIG. 5 shows a laid-flat blank for another embodiment of a wrap and pack according to FIGS. 6 to 8, FIG. 6 shows a view corresponding to FIG. 2 of the embodiment according to FIG. 5, FIG. 7 shows a vertical section corresponding to FIG. 3 of the embodiment according to FIGS. 5 and 6, FIG. 8 shows a vertical section through the pack according to FIGS. 5 and 6, in the side region, FIG. 9 shows a laid-flat blank for a further illustrative embodiment of the pack, namely according to FIGS. 10 and 11, FIG. 10 shows a central vertical section through the pack according to FIG. 9, FIG. 11 shows a horizontal section through a pack according to FIGS. 1 to 10, FIG. 12 shows a laid-flat blank for a further illustrative embodiment of a wrap, namely as shown in FIGS. 13 and 14, FIG. 13 shows a central vertical section of the illustrative embodiment of FIG. 12, FIG. 14 shows a perspective view of the upper part of the wrap according to FIGS. 12 and 13, FIG. 15 shows a laid-flat blank for a wrap formed on the crosswise lapping principle, FIG. 16 shows a vertical section through a pack containing a wrap according to FIG. 15, FIG. 17 shows successive blanks, within a portion of a laid-flat web of the packaging material for a further illustrative embodiment of the wrap, FIG. 8 shows a perspective view of the upper part of the wrap made from a blank according to FIG. 17 and FIG. 19 shows a detail of the ready-to-pack blank according to FIG. 17, in the laid-flat position.

The illustrative embodiments depicted in the drawings show the preferred field of use, namely the construction of wraps or packs for cigarettes and the like. FIG. 1 shows an example of a cigarette pack of the hinge-lid box type. This consists of a box portion 20 for receiving the contents of the pack, and a lid 21 hinged to a rear wall thereof. A collar 22 is inserted into the box portion 20 and is glued to the inside of a front wall and of the narrow side walls of the box portion 20. The collar 22 forms a collar front wall 23 projecting from the box portion 20, and collar side walls 24. When the pack is closed, these are encompassed within the hinge-lid 21. The collar front wall 23 is provided with a cut-out 25, which, in its middle region, merely bounds a narrow collar strip 26 which projects from the box portion 20.

The contents of the pack, that is to say, in the present case, a group of cigarettes 27, is enclosed in a wrap 28. This can consist of a conventional tinfoil, but also of two-layer or multi-layer laminated foils. Advantageously, the wrap 28 is so constructed or folded and sealed as to create a substantially impermeable wrap 28. In order to provide access to the contents of the pack, a special tear-open device is provided. This consists, in the present illustrative embodiments, of a free tear-open tab 29 and a pull-off strip 30 adjoining it. In all the illustrative embodiments shown, the tear-open tab 29 is formed in the region of a front wall 31 of the wrap 28. The adjoining pull-off strip 30 extends in the upper region of the front wall 31 and in at least a part-region of an upper wall 32 of the wrap 28. Furthermore, the tear-open tab 29 extends in the middle region of the front wall 31, within the cut-out 25 of the collar 22. The arrangement is such that at least a free edge region of the tear-open tab 29 rests externally on the collar 22, namely on its collar strip 26. When the pack is closed (for example FIG. 3), the hinge-lid 21 covers the tear-open tab 29.

The pull-off strip 30 which adjoins the tear-open tab 29 is in the present case marked by tear lines 33, 34. The pull-off strip 30, thus defined, is located, in the front wall 31, within the cut-out 25 of the collar 22, and in particular broadens out in the upward direction. In the upper wall 32, a rectangular region of the pull-off strip 30 is marked out, and, if desired, the transverse tear line 34 can be omitted if the pull-off strip 30 is not to be removed completely but is to remain joined to the wrap 28 in this region.

The tear lines 33, 34 can be formed in various ways. In the case of a tinfoil, isolated punched cuts are advisable, and to maintain the impermeability of the wrap 28 these cuts are covered with a coating 35 of a tearable impermeable material, for example consisting of a plastic (shown shaded in the Figures illustrating the blanks). Alternatively, the tear lines 33, 34 can be formed by thermal-mechanical embossing, in particular where two-layer and multi-layer laminated foils having an external, heat-activatable coating are concerned.

The tear-open tab 29 consists of a local material overlap. In the illustrative embodiment of FIGS. 1 to 4, the blank for the wrap 28 is provided with a double-layer fold 36, in the manner of a Z-fold, which extends over the entire width. For this purpose, the blank of appropriate size (FIG. 4) is provided, in the region of the front wall 31 and of the adjoining side tabs 37, with a transverse folding strip 41 which is for example defined by embossed lines 39, 40. This strip forms the inner layer within the fold 36. The fold 36, which in the present case extends over the entire width of the blank, is provided with incisions 42, 43 to define the tear-open tab 29. These incisions facilitate the process of starting a tear and at the same time delimit the tear-open tab 29 from the remainder of the fold 36, which fold rests tightly against the wrap 28. The tear lines 33 adjoin the abovementioned incisions 42, 43. A transverse tear line 70 is formed along the internal throat, and this tear line may be prepared in, say, the same way as the tear lines 33, 34; the tear line 70 facilitates tearing the tear-open tab 29 off the front wall 31.

The illustrative embodiment according to FIGS. 5 to 8 shows a tear-open tab 29 of modified construction. This tab is exposed within the blank (FIG. 5) not only by the incisions 42, 43, but also by a transverse severing cut 44. On forming the fold 36, merely two layers of material—namely the tear-open tab 29 and the remaining portion of the front wall 31—are pushed over one another in the region of the tear-open tab 29. Outside the tear-open tab 29 the fold 36 is formed, with a narrower folding strip 41, in the same manner as in the preceding illustrative embodiment, but with correspondingly smaller dimensions.

The tear-open tab 29, which thus consists of a single layer, forms a free edge strip 45 for gripping, and for resting against the collar strip 26. This edge strip is adjoined by a transverse connecting strip 46, which, by welding, gluing or the like, forms a detachable connection between the tear-open tab 29 and the front wall 31 of the wrap 28, preferably in accordance with the conventional peel-seal principle.

As is shown furthermore by the vertical section according to FIG. 8, which section is located outside the region of the cut-out 25 of the collar 22, the fold 36 in this region is covered by being located behind the collar 22.

A further variant in respect of the manufacture and design of the tear-open tab 29 and of the pull-off strip 30 may be seen in FIGS. 17 to 19. The above-mentioned parts of the blank are here divided from the blank by lateral cuts 47 and 48, which in the present illustrative embodiment diverge, except for a transverse foldline 49. The pull-off strip 30 here extends into the region of an adjacent blank, namely into the region of an inner tab 50 of the upper wall 32 of the wrap 28. This produces a cut-out, in the presence case V-shaped, in the blank, in the upper region of the front wall 31 and in the upper wall 32, namely in an outer tab 51 thereof.

In order to prepare the blank correctly for folding, the blank is severed from the web and a relative shift of the pull-off strip 30 is then effected, in such a way that this strip covers, with its edges, the blank in the region of the V-shaped cut-out. Here, correspondingly diverging connecting strips 52, 53 are formed—preferably in the same way as the connecting strip 46. A folding strip 54, which here is formed along the width of the tear-open tab 29, is laid Z-shaped during the process described, and as a result forms a fold in the manner described, which fold ultimately forms the tear-open tab 29. On opening the pack thus formed, by gripping the tear-open tab 29, the pull-off strip 30 is accordingly pulled off by detachment of the connecting strips 52, 53.

The opening devices for the wrap 28 which have been described permit the wrap to be constructed in a substantially impermeable manner, whilst offering a plurality of different possible constructions.

In the illustrative embodiments of FIGS. 1 to 10, the wrap 28 is in each case so constructed that it is placed from above, in a U-shaped manner, around the pack contents. This forms an upper wall 32 which is free from folding tabs. On the other hand, the bottom 55 of the wrap 28 consists of mutually partially overlapping bottom tabs 56, 57. Side walls 58 and 59 of the wrap 28 are formed from the side tabs 37, 38 which also partially overlap one another. The tabs in question are each provided with connecting strips 60, by means of which a firm, durable bond is produced by gluing, heat-welding or the like. The plastic strips or glued strips which may be applied to the blank to form these connecting strips 60 are shown shaded and dotted in each of the drawings. Advantageously, these strips are applied by printing in one and the same operation as the application of the coating 35.

The wrap 28 according to FIGS. 9 and 10 is also provided with bottom tabs 56, 57. These each have thin strips 61, 62, for forming a thin seal 63. Such a thin seal 63 is distinguished by particularly high impermeability. Examples of the arrangement of the tear-open device, namely the tear-open tab 29 with pull-off strip 30 at the end of a blank, are shown in FIGS. 12 to 16. The fold according to FIGS. 12 to 14 is here also U-shaped, in particular starting from the bottom 55. The upper wall 32 is formed by the inner tabs 50 and the outer tabs 51, which partially overlap one another. The pull-off strip 30 is formed in the region of the outer tab 51, and, in the illustrative embodiment shown, has the particular feature that as a result of corresponding edge cuts 64 and 65 the entire outer tab 51 can be pulled off as a component of the pull-off strip 30. In this construction of the wrap 28, corner tabs 66 and 67 on inner tabs 50 and outer tabs 51 are of importance. The said corner tabs 66, 67 are folded in the plane of the upper wall 32, so that the outer tab 51 is laterally connected to the (larger) corner tab 66, in such a way that on opening the pack the outer tab 51 can be pulled off this corner tab 66 (and off the inner tab 50).

FIGS. 15 and 16 are an example of a wrap 28 formed on the crosswise lapping principle. Accordingly, the blank is placed around the contents of the pack, in the shape of a tube. In the region of a side wall, side tabs 68, 69 are joined to one another, with partial overlap. The opening device is here constructed in virtually the same manner as in the illustrative embodiment of FIGS. 12 to 14.

The features of the wraps, blanks and the like, described above, can, as is clear, be mutually interchanged in order to create other combinations. The various connecting strips are in each case located on the blanks in such a way that they accord with the particular folding arrangement to create an at least substantially impermeable pack.

We claim:

1. A cuboid pack for cigarettes, small cigars and the like, comprising a wrap (28) consisting of a thin packaging material, and an outer wrap; said outer wrap comprising a hinge-lid box including a collar (22) having a cut-out (25) formed therein; wherein a freely projecting tear-open tab (29) is formed by a material overlap, said overlap extending transversely across a front wall side (31) of said thin wrap (28) within the region of said cut-out (25), wherein a free edge portion of said tear-open tab rests upon an external portion of said collar, said tear-open tab adjoining a pull-off strip (30) extending upwardly from said cut-out.

2. A pack as claimed in claim 1, wherein the tear-open tab (29) consists of a fold (36) formed in the wrap (28).

3. A pack as claimed in claim 1 or 2, wherein the material overlap (fold 36) extends transversely over at least the front wall (31) of a blank for the wrap (28), a middle part-region of said wall being marked out as the tear-open tab (29), by lateral incisions (42, 43).

4. A pack as claimed in any of claims 1 to 3, wherein the tear-open tab (29) is formed by a single-layer overlap (FIG. 6).

5. A pack as claimed in claim 4, wherein the tear-open tab (29) is glued or sealed, outside a free grippable edge strip (45), in a detachable manner to the wrap (front wall 31) by means of a transverse connecting strip (46), preferably on the peel-seal principle.

6. A pack as claimed in claim 4 or any of the subsequent claims, wherein a fold (36) of lesser width is formed outside the region of the single-layer tear-open tab (29).

7. A pack as claimed in claim 1, wherein said pull-off strip (30) is delimited by tear lines (33, 34).

8. A pack as claimed in claim 7, wherein the tear lines (33, 34) comprise punched cuts carrying a coating (35) of a tearable impermeable material, when said wrap (28) consists of tinfoil.

9. A pack as claimed in claim 7, wherein the pull-off strip (30) extends in the upper region of the front wall (31) and in at least one adjoining part-region of an upper wall (32) of the wrap (28).

10. A pack as claimed in claim 1, wherein said pull-off strip (30) is formed within the cut-out (25) and increases in width in the upward direction.

11. A pack as claimed in claim 1 or any of the subsequent claims, wherein a separate pull-off strip (30), formed by punching out of the blank of the wrap (28), is bonded to the wrap (28) by gluing, welding and the like, as a result of having been shifted relative to the blank so as to produce edge overlap in the region of the cut-out (25) formed by the pull-off strip (30), the bonding being such that a free edge is left free as the tear-open tab (29) and the pull-off strip (30) is detachable from the blank in the region of connecting strips (52, 53) in order to open the pack (FIGS. 17 to 19).

12. A pack as claimed in claim 11, wherein the pull-off strip (30) is of divergent V-shaped and is joined to the blank of the wrap (28) in the region of a foldline (49) which can be torn open.

13. A pack as claimed in claim 1, wherein a continuous folding strip (41) in the region of the front wall (31) and adjoining side tabs (37) is marked out in a blank for the wrap (28), in order to form the fold (36) or tear-open tab (29).

14. A pack as claimed in claim 1, wherein said tear-open tab (29) comprises a double-layer constructed as a fold, and transverse tear line (70) is formed in the region of an inner throat.

15. A pack as claimed in claim 1, wherein said tear-open tab (29) is covered, when the pack is closed, by a hinge-lid (21).

16. A pack as claimed in claim 1, wherein the wrap (28) is rendered impermeable by connecting strips (60) in the region of tabs which overlap as a result of folds.

17. A pack as claimed in claim 1, wherein a blank of the wrap (28) is placed in a U-shape around the contents of the pack, so that an upper wall (32) is closed over its entire extent and folds are formed in the region of a bottom (55) and in the region of side walls (58, 59).

18. A pack as claimed in claim 17, wherein the bottom (55) is sealed by a thin seal (63).

19. A pack as claimed in claim 1, wherein the blank of the wrap (28), having a closed bottom (55), is placed in a U-shape around the contents of the pack, so that folds are formed in the region of the upper wall (32) and the pull-off strip (30), in the region of the upper wall (32), extends over the entire width of the latter, that is to say is formed by an outer tab (51).

20. A pack as claimed in claim 19, wherein the outer tab (51), forming part of the pull-off strip (30), is divided by edge cuts (64, 65) from the adjoining front wall (31) and from corner tabs (66) connected to the side tabs (38).

21. A pack as claimed in claim 1 or any of the subsequent claims, wherein the wrap (28) is formed from a blank which can be folded on the crosswise lapping principle.

* * * * *